US006338562B1

(12) United States Patent
Dumont et al.

(10) Patent No.: US 6,338,562 B1
(45) Date of Patent: Jan. 15, 2002

(54) LIGHT FITTING UNIT HAVING RELEASABLE IMMOBILIZER

(75) Inventors: Eric Dumont, Domart sur la Luce; Jean-François Monteil, Isles sur Suippe, both of (FR)

(73) Assignee: ATX S.A., Noisy le Sec (FR)

( * ) Notice: Subject to any disclaimer, the term of this patent is extended or adjusted under 35 U.S.C. 154(b) by 0 days.

(21) Appl. No.: 09/391,648

(22) Filed: Sep. 7, 1999

(30) Foreign Application Priority Data

Sep. 7, 1998 (FR) ..... 98 11147

(51) Int. Cl.[7] ..... F21V 17/00; F21V 33/00
(52) U.S. Cl. ..... 362/85; 362/253; 362/375
(58) Field of Search ..... 362/154, 155, 362/282, 284, 322, 394, 374, 85, 253, 156; 361/2, 54, 56, 724, 726, 727

(56) References Cited

U.S. PATENT DOCUMENTS 4,247,882 A * 1/1981 Prager et al. ..... 361/380
5,415,544 A * 5/1995 Derrick et al. ..... 362/84
5,640,061 A * 6/1997 Bornhorst et al. ..... 307/150
5,721,669 A * 2/1998 Becker et al. ..... 361/685
6,084,691 A * 7/2000 Tsai et al. ..... 358/474
6,144,549 A * 11/2000 Moss et al. ..... 361/691

FOREIGN PATENT DOCUMENTS

| | | |
|---|---|---|
| DE | 32 30 337 | 2/1984 |
| EP | 0 501 371 | 9/1992 |

* cited by examiner

*Primary Examiner*—Sandra O'Shea
*Assistant Examiner*—Jacob Choi
(74) *Attorney, Agent, or Firm*—Young & Thompson

(57) ABSTRACT

A light fitting unit in which the closure device includes a slider which can move on its base and is adapted to hook onto the diffuser, the slider is associated with releasable immobilizing means operated by the diffuser and adapted to oppose movement of the slider in the direction toward its closed position when the diffuser is in its open position and the safety switch for controlling the supply of electrical power to the unit is itself operated by the slider.

11 Claims, 2 Drawing Sheets

LIGHT FITTING UNIT HAVING RELEASABLE IMMOBILIZER

Figure 1:
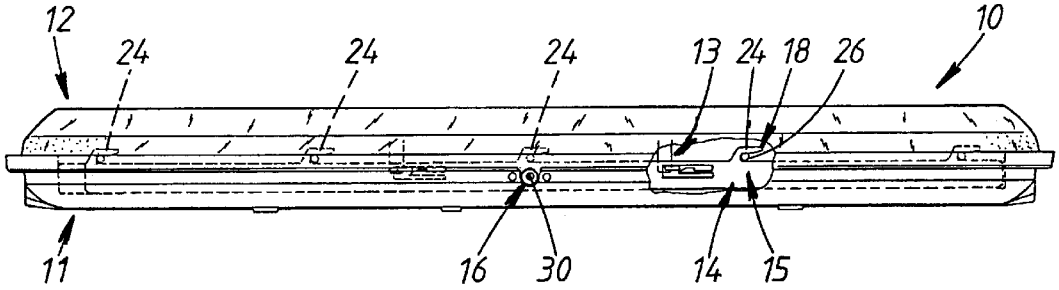

The present invention is generally concerned with light fittings comprising a base adapted to be mounted on a support of any kind, for example, and a diffuser mobile relative to the base and able to move between two positions, namely a closed position in which it prevents access to the interior volume of the unit and an open position in which it enables such access. A closure device operative between the diffuser and the base releasably locks the diffuser to the base. A safety switch controlling the electrical power supply to the unit is open when the diffuser is in its open position.

The present invention is more particularly directed to the situation in which the closure device includes a slider operated by actuator means accessible to the user from the outside and moving longitudinally on the base between a closed position and an open position respectively corresponding to the closed position and the open position of the diffuser. Coupling means operative at least locally on the path of movement of the slider enable the diffuser to be hooked onto the slider.

Such light fittings are used in explosive atmospheres, for example.

When a light fitting of this kind is opened, for example to carry out a maintenance operation, its power supply is normally systematically isolated as soon as it opens and is normally not reconnected until it has been closed.

Thus the operative can normally work in complete safety and there is normally no risk of any sparks occurring while the operative is working.

In practice, however, the means provided for this purpose can be faulty.

The safety switch may be inadvertently closed when the diffuser is in the open position, for example.

Or the safety switch may be stuck in the closed position when the diffuser is opened.

Such incidents can obviously have serious consequences.

A general object of the present invention is a totally safe way to prevent such incidents.

To be more precise, the present invention consists in a light fitting of the above kind which is generally characterized in that the slider is associated with releasable immobilizing means operated by the diffuser and adapted to oppose movement of the slider in the direction toward its closed position when the diffuser is in its open position and in that the safety switch is itself operated by the slider.

This prevents unintentional movement of the slider when the diffuser is in the open position and the slider is therefore prevented from operating the safety switch when the diffuser is in the open position.

In one preferred embodiment of the invention, the slider carries a ramp which positively opens the safety switch when it is in its open position.

In other words, in this embodiment of the invention, the slider holds the safety switch open when it is in its open position.

In other words, and in contrast to the usual arrangements, the safety switch is operated when the diffuser is open instead of unoperated.

This advantageously prevents all risk of the safety switch being stuck in the closed position when the diffuser is opened, which is to the benefit of safety.

Likewise, the slider covers the safety switch when the diffuser is in the open position and therefore prevents operation of the switch, which prevents all risk of unintentional operation of the safety switch when the diffuser is in the open position, which is again beneficial to safety.

In another preferred embodiment of the invention, when the slider operating means include a pinion rotating on the base and meshing with a rack fastened to the slider, which is the usual arrangement, the height of the teeth of the rack progressively decreases at one end at least of the rack.

The pinion can therefore escape from the rack at the end of its travel, which has the advantage of limiting the loads applied to the system and that the resulting rasping noise tells the operator that the rack has reached the end of its travel if the operator has failed to notice this by any other means.

Figure 3:
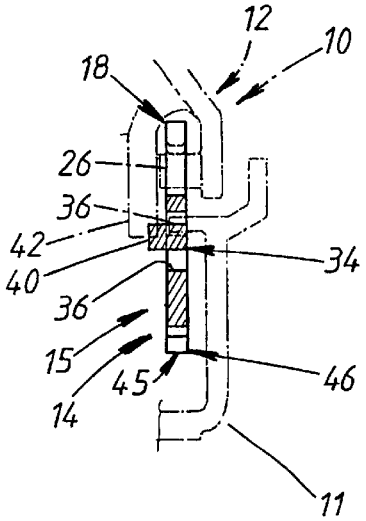
Figure 4:
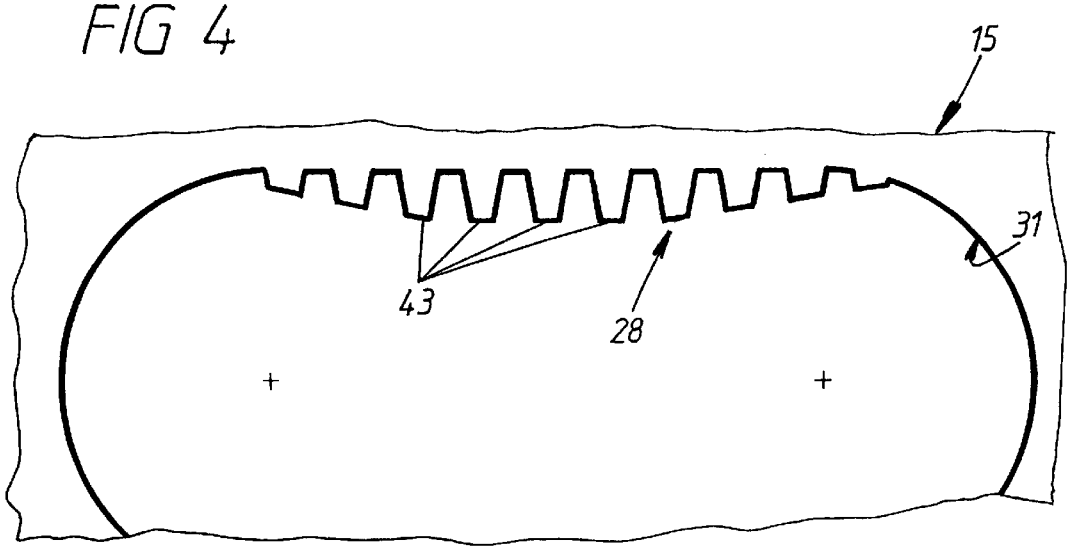
Figure 2:
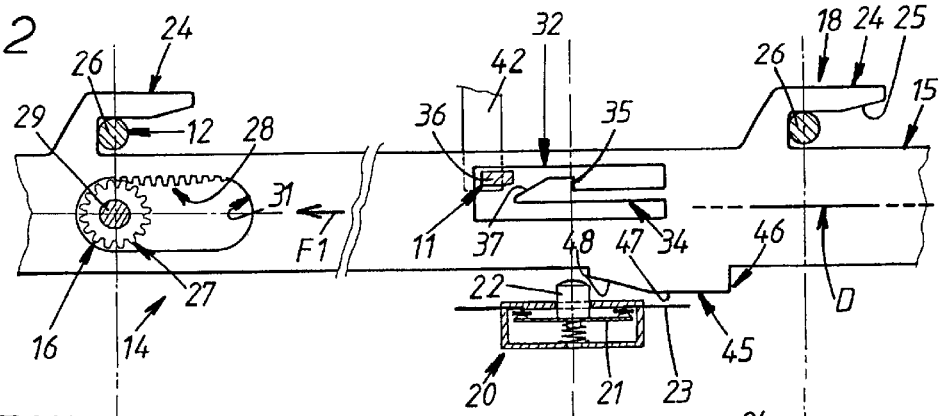
Figure 5A:
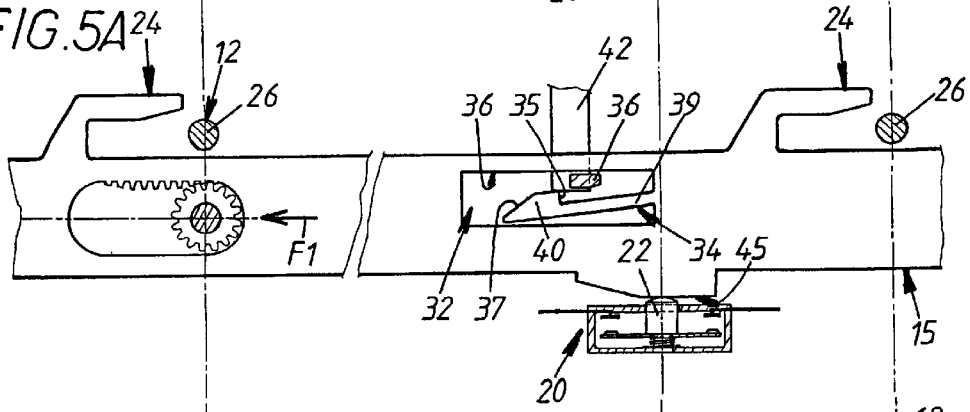
Figure 5B:
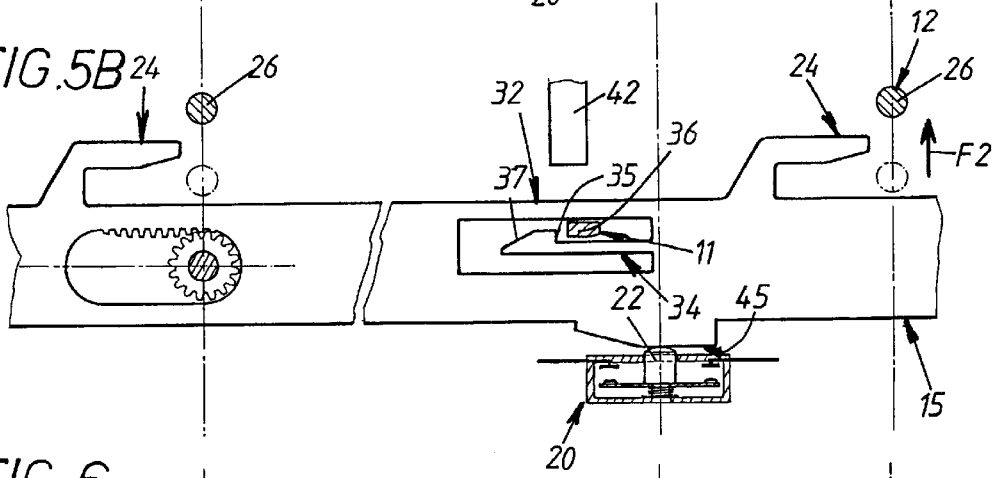
Figure 6:
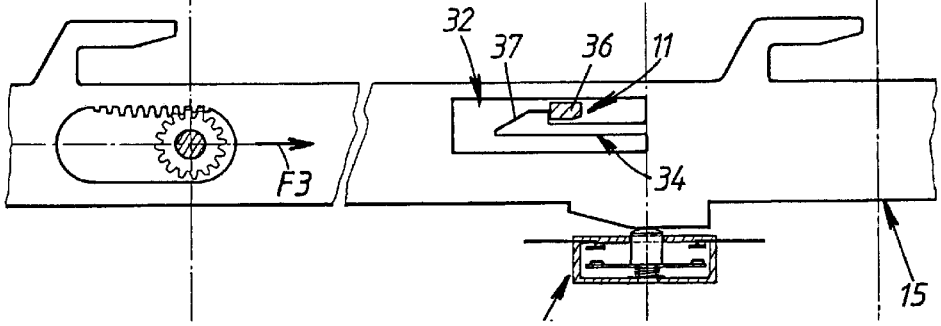

The features and advantages of the invention emerge from the following description which is given by way of example and with reference to the accompanying diagrammatic drawings, in which:

FIG. 1 is a locally cut-away view in elevation of a light fitting of the invention, FIG. 2 shows to a larger scale and in its entirety the part of FIG. 1 which is exposed by virtue of the partial cut-away therein and concerns the closure device of the light fitting, shown in the configuration it assumes when the diffuser of the light fitting is in the closed position, FIG. 3 is a partial view of the slider of the closure device in cross section taken along the line III—III in FIG. 2, FIG. 4 is a partial elevation view derived from that of FIG. 2 and showing only the rack of the slider, FIGS. 5A, 5B are partial views analogous to that of FIG. 2 and showing respective successive phases of operation of the closure device of the invention as the diffuser moves from its closed position to its open position, and FIG. 6 is a partial elevation view which is also analogous to that of FIG. 2 and which shows how the slider of the closure device is immobilized when the diffuser is in the open position.

As shown in FIG. 1, and in a manner that is known in itself, the light fitting 10 of the invention includes a base 11 adapted to be attached to a support of any kind, not shown, or to be coupled to suspension members of any kind, also not shown, and a diffuser 12 made of a translucent or transparent material and mobile relative to the base 11 between two positions, namely a closed position in which, as shown in FIG. 1, it prevents access to the interior volume 13 of the unit and an open position, not shown, in which it enables such access.

In practice the base 11 and the diffuser 11 are elongate, generally parallelepiped-shaped and nest one within the other in a sealed manner.

For example, the diffuser 12 is articulated to the base 11 along one longitudinal edge of the unit by hinges which can also enable it to be removed, if required.

A light fitting 10 of this kind, which is intended for use in explosive atmospheres, for example, is well known in itself and is therefore not described in detail here.

Only its components necessary for understanding the invention are described.

In a manner that is known in itself, the light fitting 10 includes a closure device 14 operative between the diffuser 12 and the base 11 and adapted to releasably lock the diffuser 12 to the base 11.

In practise the closure device 14 includes a slider 15 operated by means 16 accessible to the user from the outside and mobile longitudinally on the base 11 between a closed position and an open position respectively corresponding to the closed position and the open position of the diffuser 12, and, as described in more detail later, coupling means 18 operative at least locally on the path of movement of the slider 15 and adapted to enable the diffuser 12 to be hooked onto the slider.

In practise the slider 15 is within the interior volume 13 of the unit, extending along the longitudinal edge thereof opposite that along which the diffuser 12 is articulated to the base 11.

In a manner that is known in inself, and as shown diagrammatically in FIG. 2 in particular, the light fitting 10 of the invention includes a safety switch 20 which controls the electrical power supply to the unit and which is open when the diffuser 12 is in the open position.

For example, and as shown diagrammatically in FIG. 2, the safety switch 20 includes one or more mobile contacts 21 controlled by a sliding plunger 22 and included in an electrical circuit 23 powering various electrical components within the interior volume 13 of the unit, such as a lampholder, ballast, etc.

In practise, and as shown in FIG. 2, the direction D in which the slide 15 moves is its lengthwise direction.

The slider 15 is of course engaged with guide means fastened to the base 11.

The guide means, which will be obvious to the skilled person, are not shown in the figures.

For example, they include spaced studs projecting from the base 11 engaged in slots in the slider 15.

In the embodiment shown, and in a manner that is known in itself, the coupling means 18 operative between the slider 15 and the diffuser 12 include at least one hook 24 on the slider 15 and which is elongate substantially parallel to the direction D in which the slider 15 moves and has an entry chamfer 25 at one end, and at least one lug 26 on the diffuser 12, in corresponding relationship to the hook 24, on the path of movement of the hook 24 and adapted to inter-engage therewith.

In practise, and as shown in FIG. 1, there is a plurality of hooks 24 spaced along the slider 15 and the diffuser 12 includes as many lugs 24 in corresponding relationship thereto, i.e. one lug 26 per hook 24.

In the embodiment shown, the means 16 for operating the slider 15 include a pinion 27 rotating on the base 11 and meshing with a rack 28 fastened to the slider 15. By means of a pin 29 the pinion is constrained to rotate with an operating nut 30 accessible to the user from outside the unit (see FIG. 1).

For example, and as shown here, the rack 28 is formed in a slot 31 in the slider 15 and the pinion 27 is inside the slot 31.

In practise the resulting operating means 16 are substantially in the middle area of the base 11.

According to the invention, the slider 15 is associated with releasable immobilizing means 32 operated by the diffuser 12 which, as described in more detail later, are adapted to oppose movement of the slider 15 toward its closed position when the diffuser 12 is in its open position, and the safety switch 20 is operated by the slider 15.

In the embodiment shown, the releasable immobilizing means 32 include at least one elastically deformable lug 34 on the slider 15 and carrying a transverse detent 35 and at least one abutment 36 on the base 11 which is on the path of movement of the elastically deformable lug 34 and cooperates with the detent 35.

In practise the elastically deformable lug 34 is elongate parallel to the direction D in which the slider 15 moves and its detent 35, which is preceded by an entry chamfer 37, faces toward the closed position of the slider 15.

For example, and as shown, the elastically deformable lug 34 lies within a slot 38 in the slider 15, projecting cantilever fashion from one transverse edge of the slot 38, and the abutment 36 fastened to the base 11 projects into the volume delimited by the slot 38.

In the embodiment shown, the elastically deformable lug 34 has a tail portion 39 with a relatively small cross section attached to the slider 15 and a larger head 40 which forms the detent 35 and the entry chamfer 37 and with projects laterally out of the slot 38 toward the interior volume 13 of the unit (see FIG. 3).

The diffuser 12 carries a finger 42 in corresponding relationship to the elastically deformable lug 34 and for actuating it.

In practise the finger 42 extends beyond the opening of the diffuser 12 and enters the interior volume of the base 11.

As is the case in the embodiment shown, the releasable immobilizing means 32 preferably include a plurality of elastically deformable lugs 34 spaced along the slider 15 and the same number of abutments 36 on the base 11, with the same number of fingers 42 on the diffuser 12, i.e. one abutment 36 and one finger 42 for each elastically deformable lug 34.

Again as is the case in the embodiment shown, the height of the teeth 43 of the rack 28 fastened to the slider 15 preferably decreases progressively at one end thereof at least, i.e. at one end at least of the rack 28.

For example, and as shown, the height of the teeth 43 of the rack 28 decreases progressively at both ends.

It is therefore exactly as if the teeth 43 were leveled off with a curved profile (the envelope of their crests) with its convex side facing toward the interior of the slot 31 in the slider 15.

In the embodiment shown, the number of shorter teeth 43 at one end of the rack 28 is different from the number of shorter teeth 43 at its other end.

To be more precise, in this embodiment, and for reasons that will become apparent hereinafter, this number is greater at the end of the rack 28 corresponding to the open position of the slider 15 (FIGS. 5A and 5B) than at the end of the rack 28 corresponding to the closed position of the slider (FIG. 2).

Again as is the case in the embodiment shown, the slider 15 preferably carries a ramp 45 which positively opens the safety switch 20 when it is in its open position.

In practise the ramp 45 is formed by the edge of a boss 46 projecting for this purpose from the slider 15 and whose path of movement impinges on the plunger 22 of the safety switch 20.

For simplicity, it has been assumed in the figures that the boss 46 is in the same general plane as the slider 15.

However, it could equally be in the form of a right-angled rim on the slider 15, for example, if required.

Be this as it may, in the embodiment shown, the ramp 45 has a straight portion 47 substantially parallel to the direction D in which the slider 15 moves and an oblique entry portion 48 at the end of the straight portion 47 nearer the safety switch 20.

When the diffuser 12 is in the closed position the hooks 24 on the slider 15 are engaged with the lugs 26 on the diffuser 12, as shown for two of them in FIG. 2, and the diffuser 12 is therefore held firmly in its closed position on the base 11.

As shown in FIG. 2, the safety switch 20 is in its closed position at this time.

When the slider 15 is moved from its closed position to its open position by the operating means 16, as symbolized by an arrow F1 in FIGS. 2 and 5A, each of its elastically deformable lugs 34 impinges as it moves on the corresponding finger 42 of the diffuser 12, which obliges it to flex elastically, as shown in the case of one of them in FIG. 5A, and enables it to pass under the corresponding abutment 36 of the base 11 without interfering with the abutment 36.

The hooks 24 on the slider 15 are disengaged from the lugs 26 on the diffuser 12, as shown for two of them in FIG. 5A.

This releases the diffuser 12 which can therefore be opened, as symbolized by an arrow F2 in FIG. 5B.

Because of the resulting disengagement of the fingers 42 of the diffuser 12, each of the elastically deformable lugs 34 of the slider 15 resumes its original configuration, because of its inherent elasticity, as a result of which its detent 35 engages behind the corresponding abutment 36 of the base 11, as shown in the case of one of them in FIG. 5B.

As will become apparent hereinafter, this prevents excessive retrograde movement of the slider 15.

The slider 15 also opens the safety switch 20 when its ramp 45 depresses the plunger 22 of the switch (FIGS. 5A and 5B).

The immobilized slider 15 positively holds the safety switch 20 in the open configuration.

Thus the safety switch 20 is operated when the diffuser 12 is in the open position.

In other words, the return spring acting on its mobile contact (s) 21 is compressed.

In practise, when the slider 15 is in the open position, the rack 28 is substantially at the end of its travel relative to the pinion 27 with which it meshes.

Because of the shorter teeth 43 of the rack 28 at the corresponding end thereof, the pinion 27 escapes from the teeth 43 if it is rotated further, which limits the forces transmitted by the pinion 27 to the slider 15 and has the advantage of protecting the pinion 27 and the slider 15, and also produces a rasping noise to catch the attention of the operative.

There can be a clearance between the detent 35 of the elastically deformable lugs 34 of the slider 15 and the corresponding abutment 36 on the base 11 in the end of travel position of the rack 28, as shown for one of the elastically deformable lugs 34 in FIG. 5B.

If retrograde movement of the slider 15 is then attempted, even though the diffuser 12 is in the open position, each of the elastically deformable lugs 34 of the slider 15, or at least one of them, bears on the abutment 36 on the base 11, as symbolized by an arrow F3 in FIG. 6, after taking up the corresponding clearance, as shown for one of the elastically deformable lugs 34 in FIG. 6, which immediately opposes further retrograde movement of the slider 15.

The releasable immobilizing means 32 provided for this purpose therefore hold the slider 15 in its open position for as long as the diffuser 12 is itself in its open position.

The length of the straight portion 47 of the ramp 45 on the slider 15 is made sufficient for the safety switch 20 to remain open in the event of any such small retrograde movement of the slider 15.

For the same reasons as previously, a rasping noise alerts the operative to the fact that greater retrograde movement of the slider 15 is impossible.

For the slider 15 to be able to return to the closed position, the diffuser 12 must be returned to its closed position first.

As shown in FIG. 5A, when the diffuser 12 is in its closed position, the fingers 42 of the diffuser 12 again act on the elastically deformable lugs 34 of the slider 15, which enables each of the lugs to escape from the corresponding abutment 36 on the base 11.

Of course, the present invention is not limited to the embodiment described and shown, but encompasses any variant execution thereof.

In particular, if the coupling means operative between the diffuser and the slider include hooks and lugs, as described and shown, the hooks and the lugs on the slider and the diffuser can be interchanged.

Likewise the elastically deformable lugs and the abutments of the releasable immobilizing means can be interchanged between the slider and the base on which the slider moves.

What is claimed is:

1. Light fitting unit, comprising:

a base (11);

a diffuser (12) mounted mobile relative to the base (11) and defining an interior volume between the base and the diffuser, the diffuser being movable between a closed position in which the diffuser prevents access to the interior volume of the unit and an open position in which the diffuser enables access to the interior volume;

a closure device (14) mounted operative between the diffuser (12) and the base (11) and arranged to lock the diffuser (12) releasably to the base (11);

a safety switch (20) positioned to control the supply of electrical power to the unit, the safety switch being open when the diffuser (12) is in the open position;

the closure device (14) including a slider (15) operated by a part (16) accessible to the user from outside the unit, the closure device being mobile longitudinally on the base (11) between a closed position and an open position respectively corresponding to the closed position and the open position of the diffuser (12), the slider operatively connected to the safety switch so that the slider operates the safety switch;

a coupling part (18) operative at least locally on a path of movement of the slider (15) and adapted to hook the diffuser (12) onto the slider; and a releasable immobilizer operatively connected to the slider (15) and adapted to move into an immobilizing state upon movement of the slider (15) in the direction putting the diffuser (12) in the open position.

2. Light fitting unit according to claim 1, wherein, the releasable immobilizer (32) includes at least one elastically deformable lug (34), the lug being located on the slider (15) and including a transverse detent (35), the base (11) includes at least one abutment (36) on the path of movement of the elastically deformable lug (34) and, when moved into position, cooperates with the detent (35).

3. Light fitting unit according to claim 2, wherein, the elastically deformable lug (34) is elongate parallel to a direction (D) in which the slider (15) moves.

4. Light fitting unit according to claim 2, wherein, the elastically deformable lug (34) is located in a slot (38) in the slider (15).

5. Light fitting unit according to claim 2, wherein, the diffuser (12) includes a finger (42) in a corresponding relationship to and arranged for actuating the elastically deformable lug (34).

6. Light fitting unit according to claim 2, wherein, the releasable immobilizer (32) includes a plurality of spaced elastically deformable lugs (34) positioned on the slider (15).

7. Light fitting unit according to claim 1, wherein, the part (16) for operating the slider (15) includes a pinion (27) rotatable on the base (11) and meshing with a rack (28) fastened to the slider (15), and the height of the teeth (43) of the rack (28) decreases progressively toward one end of the rack.

8. Light fitting unit according to claim 7, wherein, the height of the teeth (43) of the rack (28) decreases progressively toward two ends of the rack.

9. Light fitting unit according to claim 8, wherein, the number of short teeth (43) at one end of the rack (28) is different from the number of short teeth (43) at another end of the rack.

10. Light fitting unit according to claim 1, wherein, the slider (15) carries a ramp (45) which positively opens the safety switch (20) when the slider is in its open position.

11. Light fitting unit according to claim 1, wherein, the safety switch (20) is operated when the diffuser (12) is in the open position.

* * * * *